US006604532B1

(12) United States Patent
McClendon et al.

(10) Patent No.: US 6,604,532 B1
(45) Date of Patent: Aug. 12, 2003

(54) MARCEL CURLING IRON HAVING INSULATED ROTATABLE HANDLES

(75) Inventors: Deborah A. McClendon, 5830 Sentinal Walk Ct., Norcross, GA (US) 30093; George B. Drake, New Haven, MI (US)

(73) Assignee: Deborah A. McClendon, Norcross, GA (US)

( * ) Notice: Subject to any disclaimer, the term of this patent is extended or adjusted under 35 U.S.C. 154(b) by 0 days.

(21) Appl. No.: 09/649,558

(22) Filed: Aug. 28, 2000

Related U.S. Application Data

(60) Provisional application No. 60/151,015, filed on Aug. 27, 1999.

(51) Int. Cl.[7] ..... A45D 2/40
(52) U.S. Cl. ..... 132/224; 132/232; 219/225
(58) Field of Search ..... 132/223, 224, 132/226, 227, 229, 232, 233, 269, 271, 286; 126/226, 408; 219/225; D28/35, 36, 37, 38; 16/430

(56) References Cited

U.S. PATENT DOCUMENTS

| | | | | | |
|---|---|---|---|---|---|
| 1,662,834 | A | | 3/1928 | Marcel | |
| 2,866,468 | A | * | 12/1958 | Eldridge | 132/143 |
| 3,614,381 | A | | 10/1971 | Popeil | 219/222 |
| 3,676,902 | A | * | 7/1972 | Pearson | 132/277 |
| 4,020,443 | A | | 4/1977 | Leroy et al. | 338/28 |
| 4,101,756 | A | * | 7/1978 | Yamano | 219/222 |
| 4,267,851 | A | | 5/1981 | Plaisted | 132/33 |
| 4,576,188 | A | | 3/1986 | Barradas | 132/39 |
| 4,604,514 | A | * | 8/1986 | Thaler et al. | 219/225 |
| 4,866,248 | A | | 9/1989 | Altamore | 219/225 |
| 5,120,993 | A | | 6/1992 | Altamore et al. | 219/225 |
| 5,263,501 | A | | 11/1993 | Maznik | 132/211 |
| 5,577,607 | A | | 11/1996 | Drake et al. | 206/349 |
| 5,837,972 | A | * | 11/1998 | Padilla | 219/225 |

OTHER PUBLICATIONS

"Hair Tools" Advertisement, Kizure Hair Products, http://www.kizureproducts.com/hairtool.htm, pp. 1–2 (Feb. 3, 1999).

* cited by examiner

*Primary Examiner*—Eduardo C. Robert
*Assistant Examiner*—David Comstock

(57) ABSTRACT

A marcel curling iron featuring a short curling barrel and hair clamp for reducing burn risk and improving curl control, rounded edges on the hair clamp for making smoother curls, and freely rotatable handle covers having a thermally insuative bushing and one or more finger-notches or finger openings for greater user comfort. Also ensembles of long and short curling irons, which expand the toolset available to professional stylists. Other inventive aspects concern unique stoves for heating two or more curling irons of substantially different length, and stoves which include detachable curling-iron racks and a latch-on travel cover.

19 Claims, 7 Drawing Sheets

506
406d
508
510
500
404d 500
508
408
510
518
INTERNAL RACK
506
CASE HANDLE
406
404
516
INTERNAL RACK
404d
514
512

500
510b
510
510a
408
400
506
406
412
404
504
402
512a
512
512b

MARCEL CURLING IRON HAVING INSULATED ROTATABLE HANDLES

RELATED APPLICATION

This application is a of U.S. Provisional Patent Application No. 60/151,015, which was filed on Aug. 27, 1999. This application is incorporated herein by reference.

TECHNICAL FIELD

The present invention concerns curling irons, particularly Marcel-type curling iron and stoves for heating Marcel-type curling irons.

BACKGROUND OF INVENTION

Curling irons have been around for a long time. Marcel-type, or Marcel, curling irons were invented and later patented by Francois Rene Marcel in 1927. U.S. Pat. No. 1,622,834, which is incorporated herein by reference, describes the basic structure and workings of original Marcel curling irons. In particular, these type curling irons include a long tubular curling barrel (or rod) and an equally long concave hair clamp which pivot around a common point, like scissors. The curling barrel and the hair clamp are each attached to a corresponding handle. A freely rotatable, hard plastic tube covers each handle, providing some insulation from heat and facilitating use of the curling iron. Use of this curling iron entails heating both its curling barrel and its hair clamp in or on a stove, then inserting a section of hair between the heated barrel and clamp, and finally turning or twisting the curling iron to form a desired curl or wave.

Perhaps as a testament to its excellent design, little has changed about the Marcel curling iron in the over 70 years since its patenting in 1927. Today's Marcel curling irons follow the same basic structure and workings of the original Marcel, down even to the rotatable handle covers. One apparent innovation seems to have been the introduction of a wide selection of curling barrel diameters and shapes, or cross-sections to make smaller or larger curls and waves. For example, Kizure™ Products of Compton, Calif. sells Marcel curling irons with C-shaped cross-sections and with fixed barrel diameters of one-eighth, one-quarter, three-eighths, five-eighths, three-quarters, up to about one and a half or two inches. The length of the curling barrel and hair clamp, however, have remained relatively fixed in the five-to-seven-inch range, providing users with options to treat both wide and narrow sections of hair with the same iron.

Despite the longevity and popularity of the Marcel design, the present inventor, a professional hair stylist for 20 years, has pin pointed at least three shortcomings. First, the curling barrel (and clamp) of conventional Marcel curling irons are too long for many applications, such as making spiral curls starting at the nape area of clients. Using the conventional five-to-seven-inch-long curling barrel in this area often leads many stylists to burn their clients or to form inferior spiral curls. Second, the hair clamps of conventional Marcel curling irons typically have a square edge, which ultimately leaves undesirable creases or crimps in resulting curls or waves. And third, the rotatable hard plastic tube covering each handle gets hot and is uncomfortable for extended professional use.

Accordingly, there is a need for better performing Marcel curling irons.

SUMMARY OF INVENTION

To address this and other needs, the present inventor has devised several improvements to Marcel curling irons. An exemplary embodiment incorporating her improvements features a substantially shorter curling barrel and hair clamp for reducing burn risk and improving curl control, rounded edges on the hair clamp for making smoother curls, and freely rotatable handle covers having one or more finger-notches or openings for greater user comfort.

A second aspect of the invention concerns sets, or ensembles, of Marcel curling iron based on length. For example, one exemplary ensemble provides a curling-iron set including a long, or conventional-length, Marcel curling iron and a 50-percent shorter, Marcel curling iron. Other exemplary ensembles include long-, medium-, and short-barrel Marcel curling irons of the same or different diameters. Thus, in contrast to conventional ensembles which only provide curling irons of variant curling barrel diameters and relatively fixed length, the invention provides ensembles including curling barrels of varying lengths, thereby expanding the tool set available to stylists, particularly professional stylists.

A third aspect of the invention is a stove for two or more curling irons of substantially different length. An exemplary stove, in accord with this aspect of the invention, includes at least two chambers, with one having a depth for receiving a conventional (long) curling barrel and the second chamber having a depth approximately one half that of the first chamber for receiving a shorter curling barrel. (In some embodiments, the chambers are the same actual depth, but one has a false bottom or other barrel support structure for changing its effective depth.) The exemplary stove also includes a detachable rack for one or more curling irons and a partially detachable case convenient for traveling.

DETAILED DESCRIPTION OF PREFERRED EMBODIMENTS

The following detailed description, which references and incorporates FIGS. 1A–4, describes and illustrates one or more specific embodiments of the invention. These embodiments, offered not to limit but only to exemplify and teach the invention, are shown and described in sufficient detail to enable those skilled in the art to practice the invention. Thus, where appropriate to avoid obscuring the invention, the description may omit certain information known to those of skill in the art.

Figures 1A, 1B:
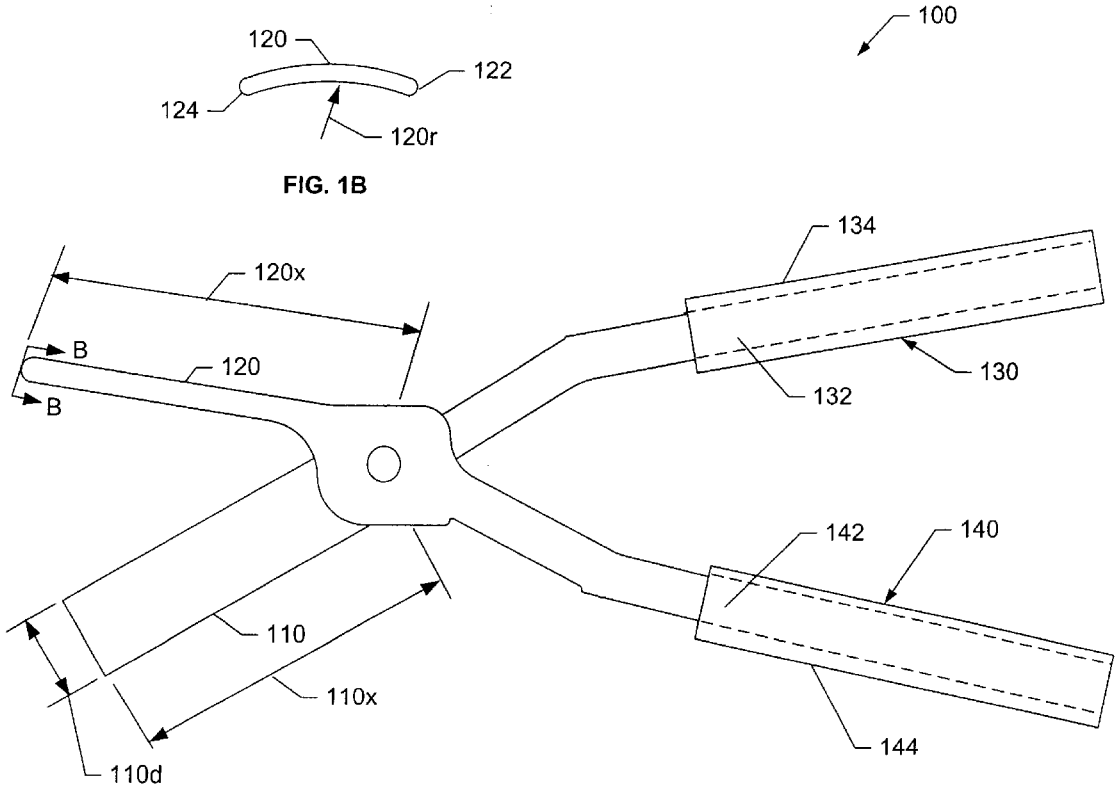
FIG. 1A is a side view of an exemplary curling iron 100 having a short curling barrel and hair clamp in accord with the present invention.
FIG. 1B is a front view of the hair clamp in FIG. 1.

FIG. 1 shows an exemplary Marcel curling iron 100 in accord with the present invention. Curling iron 100 includes a curling barrel 110, a hair clamp 120, and handles 130 and 140. Curling barrel 110 has a length 110*x* and a uniform diameter 110*d* which is shown best in the front view of FIG. 1A. Length 110*x* is generally in the range of 0.5 to 4.5 inches, inclusive. Diameter 110*d* is generally unrestricted in the exemplary embodiment. The table below lists various novel diameter-length combinations for curling barrel 100.

| Diameter 110d | Length 110x |
|---|---|
| 0.765 inches (K) | 3.2 inches |
| 0.875 inches (L) | 4.0 inches |
| 1.00 inches (M) | 3.7 inches |
| 1.25 inches (R) | 4.4 inches |

K, M, L, and R are industry designations for the associated diameters. Other embodiments, however, use other standard industry diameters with lengths within the exemplary range of 0.5 to 4.5 inches. Some embodiments use non-standard diameters within the exemplary range of 0.5 to 4.5 inches.

Although the exemplary embodiment forms curling barrel 110 as a solid steel member, other embodiments form it as a hollow tube. (One exemplary construction forms and swages 304 stainless steel tubing.) Still other embodiments form curling barrel 110 with a C-shaped cross-section. Other cross-sections are also feasible.

Hair clamp 120, which as length 120*x* generally equal to length 110*x* of curling barrel 110, engages with curling barrel 110 as known in the art to clamp hair between it and a portion of the surface of the curling barrel. As FIG. 1B shows, hair clamp 120 is concave, with a radius of curvature 120*r*, to engage the curved surface of the curling barrel. Hair clamp 120 also includes curved or rounded edges 122 and 124 which reduce or prevent crimping or creasing of hair clamped between it and curling barrel 110.

Handle 130, which is attached to curling barrel 100, includes a solid or hollow interior member 132 and an external grip member 134. External grip member 134 rotates freely about interior member 132, as known in the art. Likewise, handle 140, which is attached to hair clamp 120, includes a solid or hollow interior member 142 and an exterior grip member 144. Exterior grip member 144 rotates freely about interior member 142.

Though not clearly visible in FIG. 1, exterior grip members 134 and 144 are distinct from one another. In particular, one of the grip members has a different texture than the other to provide a tactile indication of orientation of the curling iron during operation. Exemplary textural combinations for the two grip members include smooth and rough or soft and hard. One embodiment provides one handle with a knurled surface and the other with a smooth surface; another provides one handle with a fine knurled surface and the other with a coarse knurled surface; another provides one with a pointed-type bumpy surface and the other with a blunter bumpy surface. Indeed, the combinations are endless. Therefore, this aspect of the invention is not limited to any particular type of pairing, so long as one handle has a different tactile feel than the other.

Figure 2A:
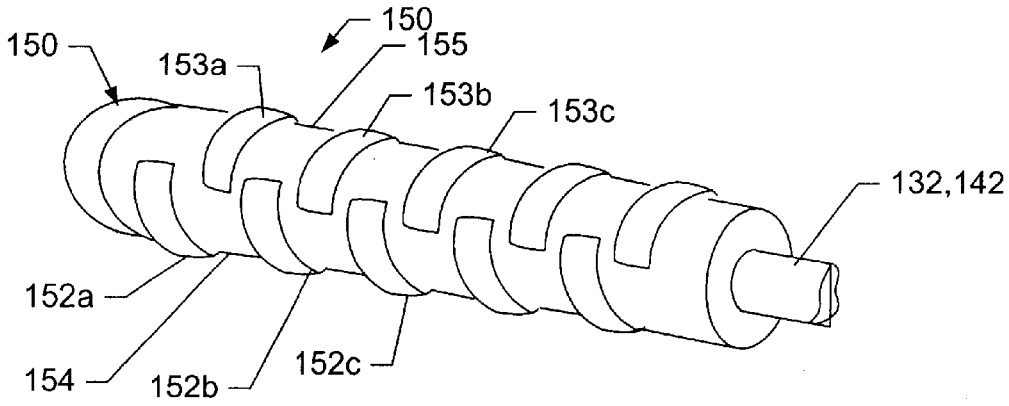
FIGS. 2A and 2B are respective perspective and cross-sectional views of an exemplary handle cover, or grip, 150 for use with Marcel curling irons of the present invention.
Figure 2B:
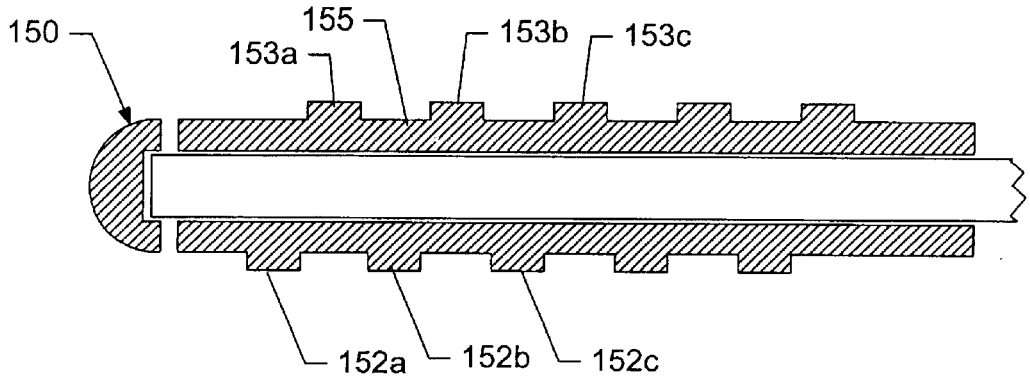

FIGS. 2A–2B, 2C–2D, and 2E–2F show three other alternative structures for use as one or both of exterior grip members 124 and 144. In particular, FIGS. 2A and 2B shows an exterior grip structure 150 which includes a number of raised interleaved and laterally offset half-ring regions 152*a*–152*c* and 152*a*–152*c*. Half-ring regions 152*a* and 152*b* are separated by a lower surface region 154, and half-ring regions 152*a* and 152*b* are separated by a lower surface region 155.

Figure 2C:
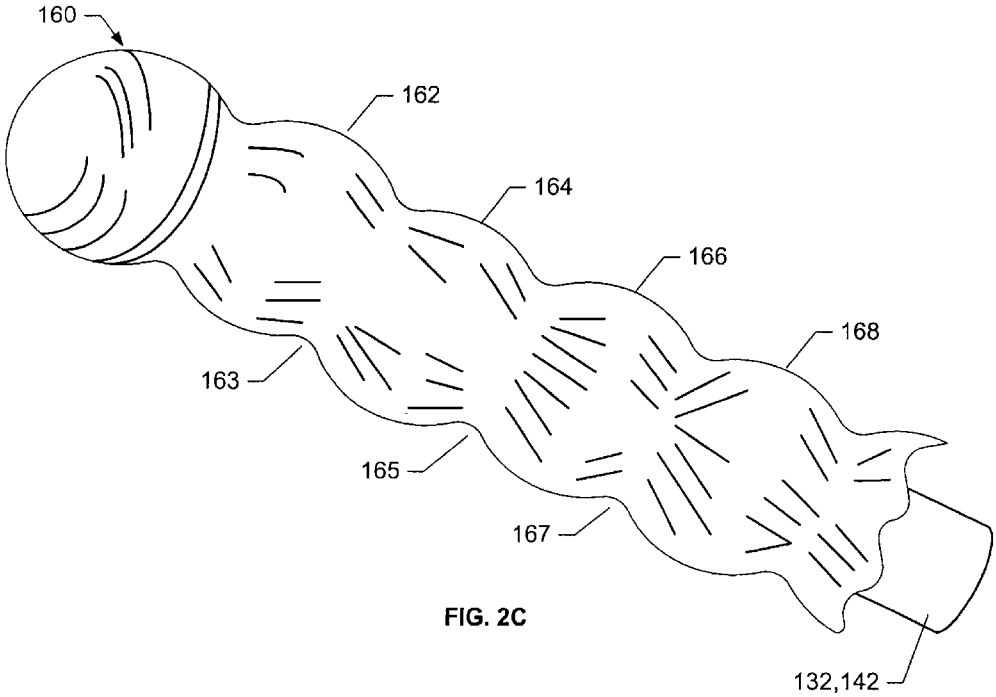
FIGS. 2C and 2D are respective perspective and cross-sectional views of an exemplary handle cover, or grip, 160 for use with Marcel curling irons of the present invention.
Figure 2D:
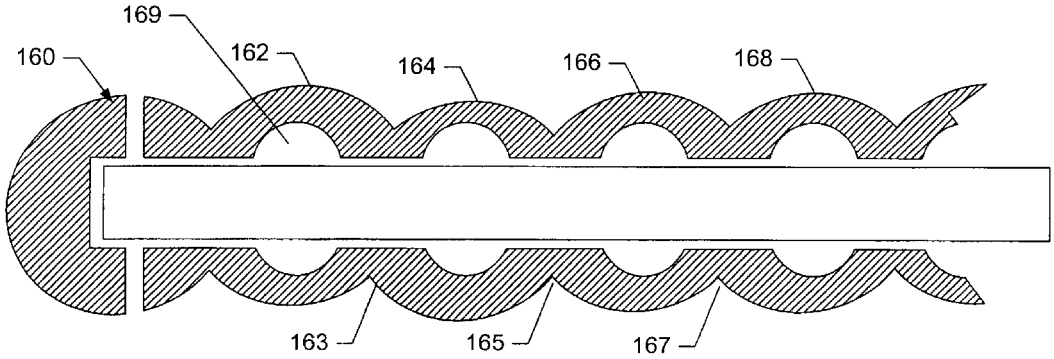

FIGS. 2C and 2D show an exemplary exterior grip structure 160. Structure 160 includes a number of raised bulbous regions 162, 164, 166, and 168. Raised bulbous regions 162 and 164 are separated by a contiguous or noncontiguous lower region 162; bulbous regions 164 and 166 are separated by a contiguous or noncontiguous lower region 165; and bulbous regions 166 and 168 are separated by a contiguous or noncontiguous lower region 167. FIG. 2D shows that each bulbous region includes a void region 169, which separates its undersurface from the interior member (122 or 142) of the handle. In the exemplary embodiment, the void region functions not only to improve the insulative capability of the grip member, but also as a cushion, with the level of cushioning dependent on the rigidity of the material constituting the grip member.

Figure 2E:
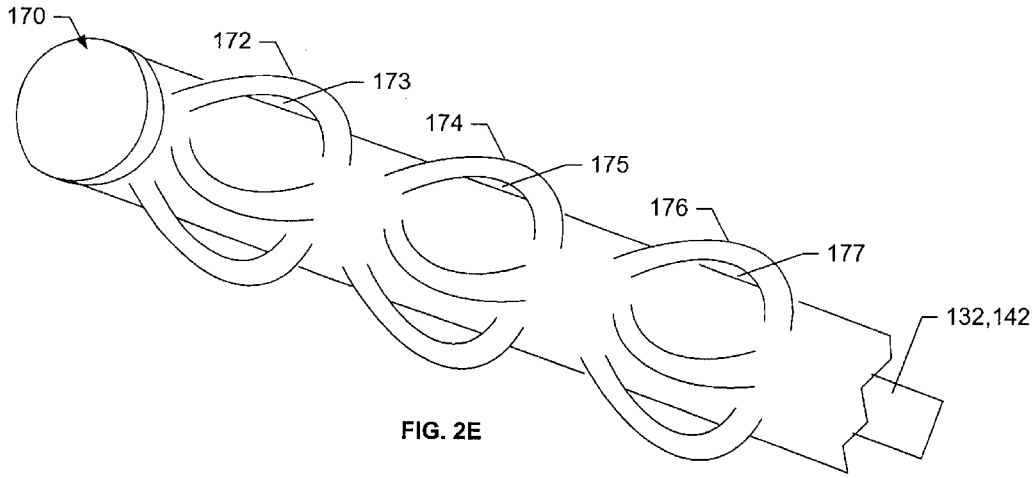
FIGS. 2E and 2F are respective perspective and cross-sectional views of an exemplary handle cover, or grip, 170 for use with Marcel curling irons of the present invention.
Figure 2F:
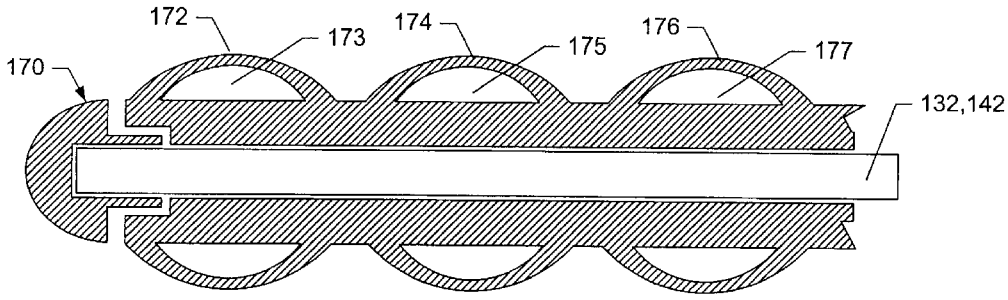

FIGS. 2E and 2F show an exemplary exterior grip structure 170. Structure 170 includes a number of open fin members 172, 174, and 176. Open fin member 172 includes respective openings 172, 175, and 176. The openings, in this exemplary embodiment, serve-a function similar to that of void regions 169 in grip structure 160.

Exemplary construction materials for the grip structures shown in FIGS. 1 and 2A–2F include plastic, rubber, and neoprene. However, the present invention is not limited to any particular material composition.

Figure 2G:
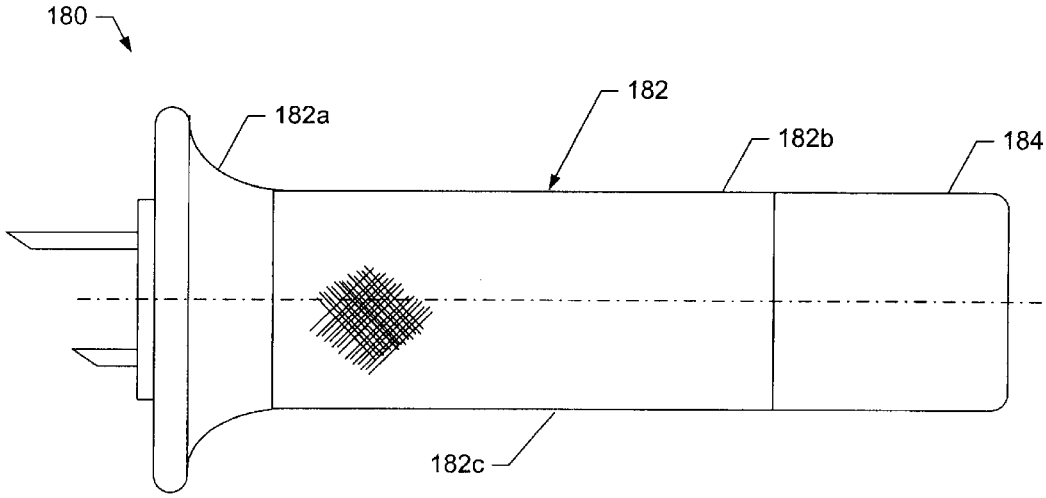
FIGS. 2G and 2H are respective side and cross-sectional views of an exemplary handle cover, or grip, 180 for use with Marcel curling irons of the present invention.
Figure 2H:
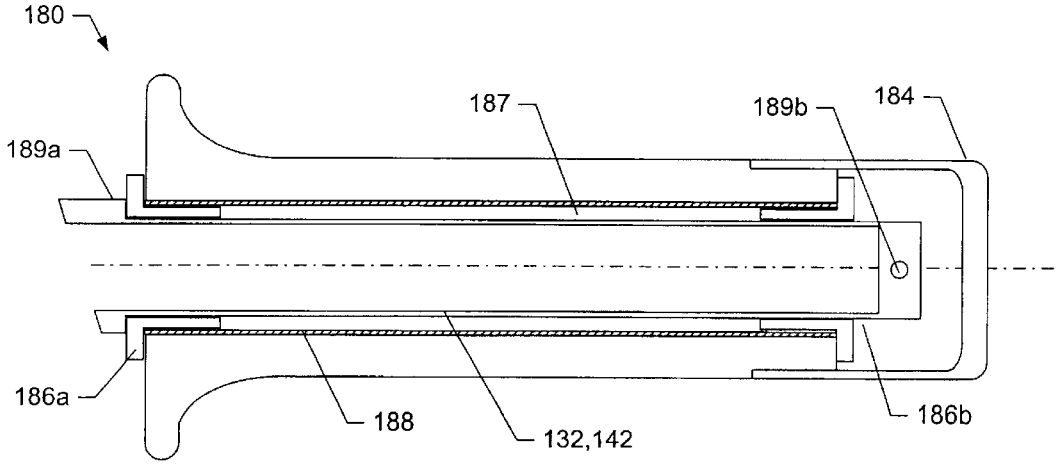

FIGS. 2G and 2H show side and cross-sectional views of exemplary grip structure 180. Exemplary grip structure 180 includes a five-eighths-inch diameter molded, thermoplastic cover 182 and a nickel-plated-steel, right-cylindrical endcap 184. Opposite endcap 184, cover 182 includes a one-inch diameter, integral, annular flange extension region 182*a*, an end region 182*b*, and a middle region 182*c* between regions 182*a* and 182*b*.

Internally, as shown specifically in FIG. 2H, grip structure 180 further includes ceramic shoulder bushings 186*a* and 186*a*, an air gap or sleeve 187, and a steel cylindrical spindle liner 188, and a handle retaining members 189*a* and 189*b*. Ceramic shoulder bushing 186*a* engages a retaining member 189*a* and bushing 186*b* engages retaining member 189*b*. In the exemplary embodiment, retaining member 189*a* is a corresponding shoulder of handle spindle 132 or 142, and retaining member 189*b* is a pin extending through the end of the handle spindle. Bushings 186*a* and 186*b* mate with respective ends 188*a* and 188*b* of spindle liner 188 to define an air gap or air sleeve 187 between handle spindle 132, 142 and liner 188. Notably, bushings 186*a* and 186*b* and air sleeve 187 thermally insulate respective portions 182*a*, 182*b*, and 182*c* from handle spindle 132, 142, lowering the operating temperature of cover 188 relative that of handle spindle 188 and facilitating user comfort.

Figures 3A, 3B, 3C:
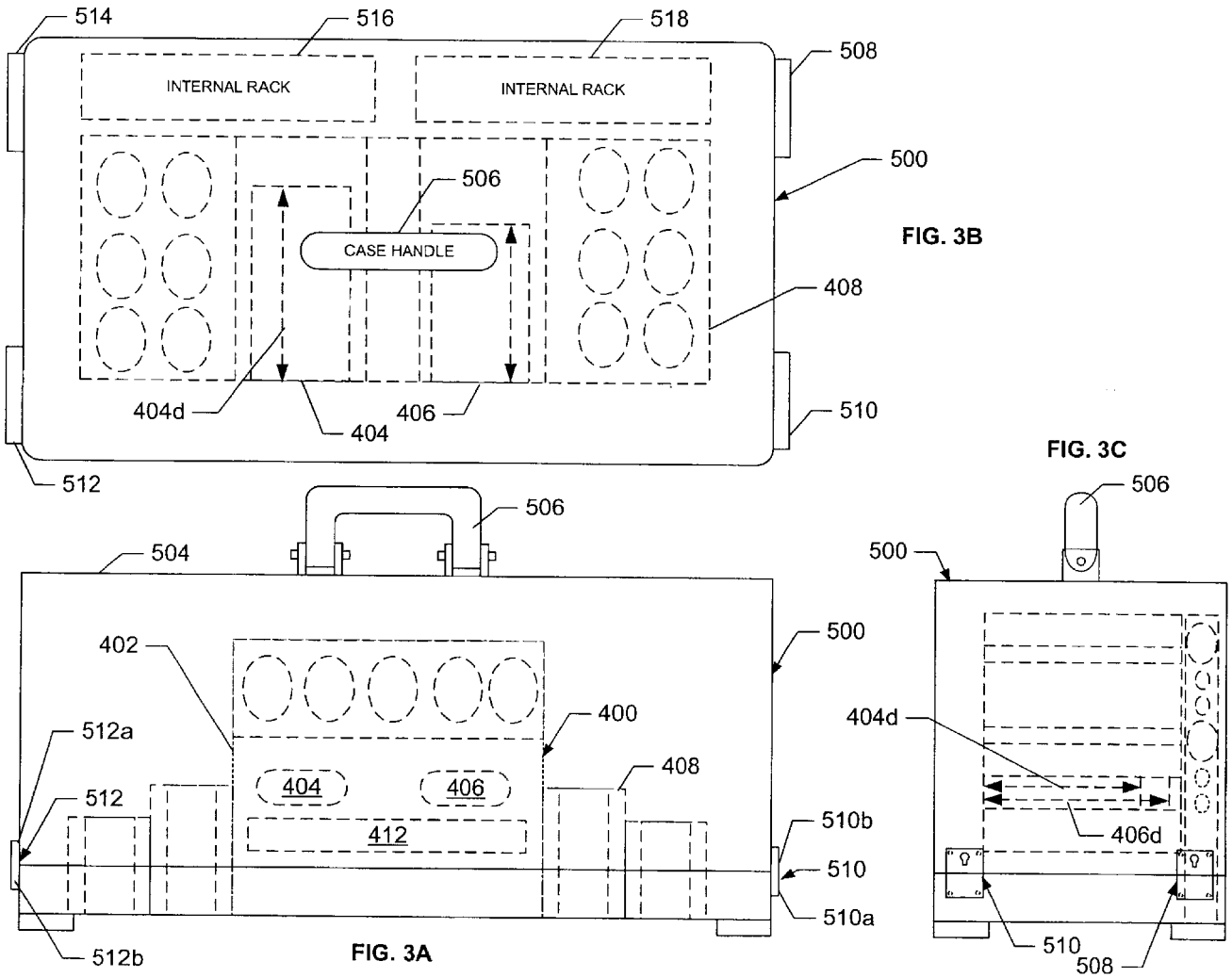
FIG. 3A ia a front view of an exemplary travel case and stove assembly 300 in accord with the present invention.
FIG. 3B ia a top view of exemplary travel case and stove assembly 300 shown in FIG. 3A.
FIG. 3C ia a side view of an exemplary travel case and stove assembly 300 shown in FIGS. 3A and 3B.

FIGS. 3A, 3B, and 3C show respective front, top, and side views of an exemplary travel-case-and-stove assembly 300, which includes stove 400 and case 500. Stove 400 is suitable for use with two or more Marcel curling irons, at least one of which is in accord with the present invention. Stove 400 includes a housing 402, a long heating chamber 404, a short heating chamber 406, a detachable side curling-iron racks 408, detachable top curling-iron rack 410, and a control panel 412. Heating chambers 404 and 406 have respective nominal depths 404*d* and 406*d*, with depth 404*d* being suitable for receiving a five-to-seven-inch-long curling barrel and hair clamp of a Marcel curling iron and with depth 406*d* being suitable for receiving a shorter curling barrel and hair clamp of a marcel curling iron in accord with the present invention.

In the exemplary embodiment, depth 406*d* is approximately one half of depth 404*d*. In other embodiments, depth 406*d* is three-quarters or one third of depth 404*d*. Though stove 400 is shown with only two chambers, other embodiments more chambers to heat more curl irons. For example, one embodiment includes three chambers with different depths: a first chamber for conventional length irons, a second for shorter irons in accord with the invention, and a third even shorter iron still in accord with the invention. Moreover, in some embodiments, each chamber is separately controllable to heat corresponding curling irons to different temperatures.

Travel case 500 includes a base 502, a cover 504, a handle 506, four latches 508, 510, 512, and 514, and internal storage racks 516 and 518. Base 502 mounts to the bottom of stove 400 using bolts, screws, weld joints, or other convenient means. Cover 504 mates with the periphery of base 502, with latches 508–512 fastening it in place. Latches 508–512 include respective base and cover portions 508*a*–512*a* and 508*a*–512*b* which are attached respectively to base 502 and cover 504. Handle 506 is hinged to cover 504. Internal storage racks (pouches or compartments) 516 and 518 are available to store curling irons and other styling tools, such as comb, brushes, and so forth. The invention is not limited to any particular shape or size or construction of the travel case, so long as it has a relatively rigid base attachable to a stove. Likewise, any currently or future available form of releasable fastener can be used to hold the cover or at least a portion of the cover in a fixed position relative to the base.

In the exemplary embodiment, using the curling-iron stove within case 500 entails unfastening latches 508–512 and removing cover 504 to expose the stove. Cover 504 can then be set aside out of the way. An electrical cord (not shown) for the stove can then be connected to an appropriate power supply and the stove operated as normal. After completion of operation, the cord and other accessories such as a variety of Marcel curling irons within and without the scope of the invention can be stored conveniently and securely within the case. After latching cover 504 in place, case 500 is ready for transport. Unlike conventional stoves which lack an attachable enclosure or transport structure, the exemplary carry structure allows one to safely transport both hot curling irons and a hot stove without risk of burning anyone or anything.

Figure 4:
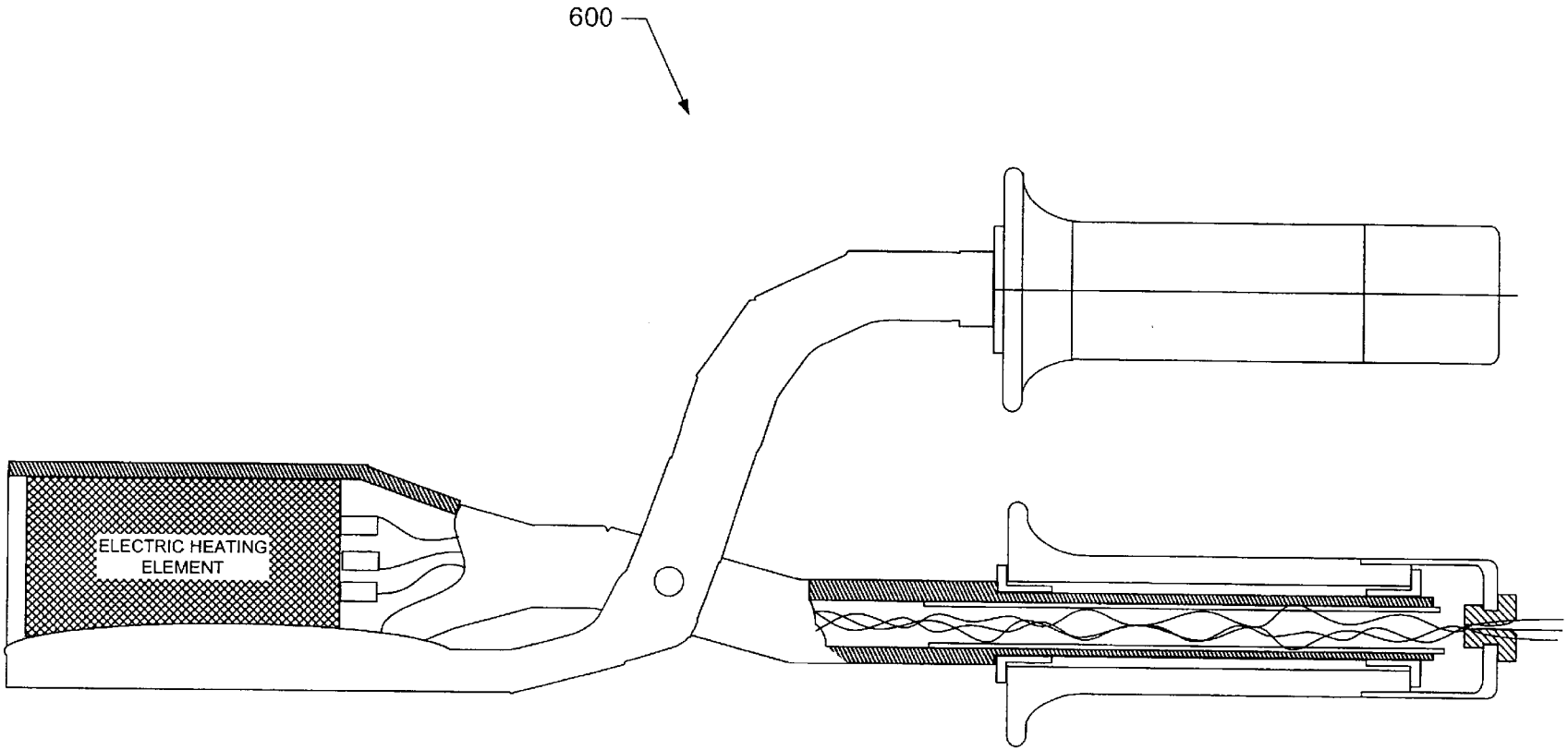
FIG. 4 shows an exemplary electric Marcel-type curling iron.

Other embodiments of the invention equip Marcel curling irons, such as those described above, with one or more electrical heating elements within the curling barrel. These heating elements have insulative electrical leads which extend through a tubular opening in the handle attached to the curling barrel. The electrical leads extend out the end of the handle and have an electrical plug for insertion in common electrical outlets. FIG. 4 shows an exemplary electric curling iron 600. Some embodiments of the electric curling iron use flat and/or braided electrical conductors to facilitate passage through constricted portions of the curling irons. Other embodiments also include a thermocouple or other temperature sensor within the heating element to faciliate termperature regulation. A temperature controller could be placed within the handle or in-line with the electrical leads extending from the handle.

Still other embodiments extend the teachings of providing short curling barrels to electric curling irons generally. Like conventional Marcel curling irons, these curling irons are conventionally provided with five-to-seven inch curling barrels and thus pose a significant burn risk to users. Accordingly, providing these curling irons with shorter curling irons would reduce burn risk while improving control.

CONCLUSION

In furtherance of the art, the inventor devised several improvements to Marcel curling irons. An exemplary embodiment incorporating her improvements features a substantially shorter curling barrel and hair clamp for reducing burn risk and improving curl control, rounded edges on the hair clamp for making smoother curls, and freely rotatable handle covers having one or more finger-notches or openings for greater user comfort. Other aspects of the invention concerns sets, or ensembles, of Marcel curling iron based on length, and a stove for two or more curling irons of substantially different length.

The embodiments described above are intended only to illustrate and teach one or more ways of practicing or implementing the present invention, not to restrict its breadth or scope. The actual scope of the invention, which embraces all ways of practicing or implementing the teachings of the invention, is defined only by the following claims and their equivalents.

What is claimed is:

1. A Marcel-type curling iron comprising:

a non-powered curling barrel adapted for heating in a curling-iron stove;

a concave hair clamp member having first and second surfaces and a peripheral edge joining the surfaces, with the hair clamp member being pivotally engageable with the curling barrel to clamp a section of hair and at least a portion of the peripheral edge being rounded to avoid creasing hair clamped between the clamp member and the curling barrel;

a pair of handle members for pivotally engaging and disengaging the curling barrel and the hair clamp member, with each handle member including:

a portion freely rotatable relative to another portion of the handle member; and a thermally-insulative bushing between the freely rotatable portion and the other portion of the handle member.

2. The Marcel-type curling iron of claim 1, wherein the freely rotatable portion includes at least one notch or opening for placing at least one finger of a user.

3. The Marcel-type curling iron of claim 1, wherein the freely rotatable portion includes an annular flange extending outward relative to the other portion of the handle member.

4. The Marcel-type curling iron of claim 1, wherein the handle member includes at least two thermally insulative bushings and each bushing comprises a ceramic material.

5. The Marcel-type curling iron of claim 1:

wherein the freely rotatable handle member comprises a cylindrical sleeve surrounding at least part of the other portion of the handle member, with the cylindrical sleeve having first and second end faces;

wherein the handle member includes at least first and second thermally insulative bushings, with each bushing having a shoulder portion, with the shoulder portion of the first bushing engaging the first end face and shoulder portion of the second bushing engaging the second end face.

6. The Marcel-type curling iron of claim 1, wherein the freely rotatable portion of one handle member in the pair of handle members has a different texture than the freely rotatable portion of the other handle member in the pair of handle members.

7. The Marcel-type curling iron of claim 1, wherein the curling barrel is formed of 304 stainless steel tubing.

8. A kit comprising:

a first passive Marcel-type curling iron having a first-curling barrel of a first nominal diameter and a first length;

a second passive Marcel-type curling iron having a second curling barrel of a second nominal diameter and second length;

wherein the second length is substantially shorter than the first length; and wherein at least one of the first and second passive Marcel-type curling irons includes a pair of handle members for pivotally engaging and disengaging its curling barrel and the hair clamp member, with each handle member including:

a portion freely rotatable relative another portion of the handle member: and a ceramic bushing between the freely rotatable portion and the other portion of the handle member.

9. The kit of claim 8, wherein the second length is about half the first length.

10. The kit of claim 8, wherein the first length is between five and seven inches and the second length is about half the first length.

11. The kit of claim 8, wherein the first nominal diameter and the second nominal diameter are substantially equal.

12. A kit comprising:

a first non-powered Marcel-type curling iron having a first curling barrel of a first nominal diameter and a first length;

a second non-powered Marcel-type curling iron having a second curling barrel of a second nominal diameter and second length which is about two-thirds of the first length; and a third non-powered Marcel-type curling iron having a third curling barrel of a third nominal diameter and third length which is about one third of the first length;

wherein at least one of the Marcel-type curling irons includes a pair of handle members for pivotally engaging and disengaging its curling barrel and the hair clamp member, with each handle member including:

a portion freely rotatable relative another portion of the handle member; and a ceramic bushing between the freely rotatable portion and the other portion of the handle member.

13. The kit of claim 12, wherein the first length is between five and seven inches.

14. The kit of claim 12, wherein the first, second, and third nominal diameters are substantially equal.

15. A Marcel-type curling iron comprising:

a non-powered curling barrel having a length less than about four inches and comprising 304 stainless steel tubing;

a concave hair clamp member having first and second surfaces and a peripheral edge joining the surfaces, with the hair clamp member being pivotally engageable with the curling barrel to clamp a section of hair and at least a portion of the peripheral edge being rounded to avoid creasing hair clamped between the clamp member and the curling barrel;

a pair of handle members for pivotally engaging and disengaging the curling barrel and the hair clamp member, with each handle member including:

a portion freely rotatable relative to another portion of the handle member, wherein the freely rotatable portion includes an annular flange extending outward relative to the other portion of the handle member; and at least first and second thermally-insulative bushings between the freely rotatable portion and the other portion of the handle member.

16. The Marcel-type curling iron of claim 15, wherein the freely rotatable portion includes at least one notch or opening for placing at least one finger of a user.

17. The Marcel-type curling iron of claim 15, wherein each bushing comprises a ceramic material.

18. The Marcel-type curling iron of claim 15:

wherein the freely rotatable handle member comprises a cylindrical thermoplastic sleeve surrounding at least part of the other portion of the handle member, with the cylindrical sleeve having first and second end faces;

wherein the handle member includes at least first and second thermally insulative bushings, with each bushing having a shoulder portion, with the shoulder portion of the first bushing engaging the first end face and shoulder portion of the second bushing engaging the second end face.

19. The Marcel-type curling iron of claim 15:

wherein the pair of handle members are approximately the same length; and wherein at least the freely rotatable portion of one handle member in the pair of handle members includes means for facilitating a user grip and reducing heat transfer from the handle member to a user.

* * * * *